US008833073B2

(12) United States Patent
Kuhlbach et al.

(10) Patent No.: US 8,833,073 B2
(45) Date of Patent: Sep. 16, 2014

(54) SEPARATELY COOLED TURBOCHARGER FOR MAINTAINING A NO-FLOW STRATEGY OF AN ENGINE BLOCK COOLANT JACKET

(75) Inventors: Kai Sebastian Kuhlbach, Bergisch Gladbach (DE); Bernd Steiner, Bergisch Gladbach (DE); Jan Mehring, Cologne (DE)

(73) Assignee: Ford Global Technologies, LLC, Dearborn, MI (US)

( * ) Notice: Subject to any disclaimer, the term of this patent is extended or adjusted under 35 U.S.C. 154(b) by 294 days.

(21) Appl. No.: 13/152,035

(22) Filed: Jun. 2, 2011

(65) Prior Publication Data

US 2011/0296834 A1 Dec. 8, 2011

(30) Foreign Application Priority Data

Jun. 7, 2010 (EP) ..... 10165035

(51) Int. Cl.

| | |
|---|---|
| ***F02B 29/04*** | (2006.01) |
| ***F02B 33/44*** | (2006.01) |
| ***F01P 7/16*** | (2006.01) |
| ***F01P 7/14*** | (2006.01) |
| ***F01P 9/00*** | (2006.01) |
| ***F02F 1/36*** | (2006.01) |
| ***F02F 1/40*** | (2006.01) |
| ***F02F 1/42*** | (2006.01) |
| *F01P 3/02* | (2006.01) |

(52) U.S. Cl.

CPC ..... *F01P 7/165* (2013.01); *F01P 2003/027* (2013.01); *F01P 2060/12* (2013.01); *F01P 2060/16* (2013.01)

USPC ..... 60/599; 60/605.3; 123/41.1; 123/41.29; 123/41.31; 123/41.82 R

(58) Field of Classification Search

CPC ..... F01P 7/165; F01P 3/02; F01P 2003/027; F01P 2060/12; F01P 2060/16

USPC ..... 60/599, 605.3; 123/41.31, 41.29, 41.1, 123/41.02, 41.82 R

IPC ..... F02B 39/00; F01P 7/16, 7/14, 3/02, F01P 3/20

See application file for complete search history.

(56) References Cited

U.S. PATENT DOCUMENTS

| | | | | |
|---|---|---|---|---|
| 2,807,245 | A * | 9/1957 | Unger | 123/41.31 |
| 3,673,798 | A * | 7/1972 | Kuehl | 60/605.1 |
| 4,381,736 | A * | 5/1983 | Hirayama | 123/41.1 |

(Continued)

FOREIGN PATENT DOCUMENTS

| | | | | |
|---|---|---|---|---|
| DE | 19628542 | A1 * | 1/1998 | F01P 3/02 |
| DE | 10219481 | A1 * | 11/2003 | F01P 3/20 |

(Continued)

*Primary Examiner* — Thai Ba Trieu

(74) *Attorney, Agent, or Firm* — Julia Voutyras; Alleman Hall McCoy Russell & Tuttle LLP

(57) ABSTRACT

An internal combustion engine is provided herein. The internal combustion engine may include a turbocharger including a turbine positioned in an exhaust passage, the turbine having a turbine housing. The internal combustion engine may further include a cooling system having an engine block coolant jacket fluidly coupled to a pump, a cylinder head coolant jacket fluidly coupled to the pump, and a turbine coolant passage traversing the turbine housing and fluidly coupled to the pump and bypassing the engine block coolant jacket.

15 Claims, 6 Drawing Sheets

(56) References Cited

U.S. PATENT DOCUMENTS

| | | | | |
|---|---|---|---|---|
| 4,520,767 | A * | 6/1985 | Roettgen et al. | 123/41.31 |
| 4,539,942 | A * | 9/1985 | Kobayashi et al. | 123/41.1 |
| 4,561,387 | A * | 12/1985 | Korkemeier et al. | 123/41.31 |
| 4,608,827 | A * | 9/1986 | Hasegawa et al. | 123/41.31 |
| 4,726,324 | A * | 2/1988 | Itakura | 123/41.1 |
| 4,739,619 | A * | 4/1988 | Koerkemeier | 60/605.3 |
| 4,829,939 | A * | 5/1989 | Veenemans et al. | 60/605.3 |
| 4,928,637 | A * | 5/1990 | Naitoh et al. | 123/41.31 |
| 4,958,600 | A * | 9/1990 | Janthur | 123/41.31 |
| 5,121,714 | A * | 6/1992 | Susa et al. | 123/41.1 |
| 5,275,133 | A * | 1/1994 | Sasaki et al. | 123/41.31 |
| 5,463,867 | A * | 11/1995 | Ruetz | 60/602 |
| 6,152,088 | A * | 11/2000 | Occella et al. | 123/41.1 |
| 6,213,062 | B1 * | 4/2001 | Kawase | 123/41.31 |
| 6,457,442 | B1 * | 10/2002 | Fuchs et al. | 123/41.29 |
| 6,513,328 | B2 * | 2/2003 | Baeuerle et al. | 60/599 |
| 7,267,084 | B2 * | 9/2007 | Lutze et al. | 123/41.02 |
| 7,669,416 | B2 * | 3/2010 | Pantow et al. | 60/599 |
| 7,784,442 | B2 * | 8/2010 | Lester et al. | 123/41.82 R |
| 7,921,829 | B2 * | 4/2011 | Hayashi | 123/41.31 |
| 8,209,980 | B2 * | 7/2012 | Takagawa et al. | 60/602 |
| 8,365,526 | B2 * | 2/2013 | Stiermann | 60/599 |
| 8,464,669 | B2 * | 6/2013 | Honzen et al. | 123/41.01 |
| 8,561,580 | B2 * | 10/2013 | Kakehashi et al. | 123/41.09 |
| 2005/0166870 | A1 * | 8/2005 | Wenderoth et al. | 123/41.01 |
| 2005/0205683 | A1 * | 9/2005 | Schmitt et al. | 237/12 |
| 2006/0157002 | A1 * | 7/2006 | Pfeffinger et al. | 123/41.29 |
| 2007/0209611 | A1 * | 9/2007 | Buck | 123/41.31 |
| 2010/0095908 | A1 * | 4/2010 | Deivasigamani | 123/41.1 |
| 2011/0023797 | A1 * | 2/2011 | Lenz et al. | 123/41.29 |
| 2011/0253076 | A1 * | 10/2011 | Mikame et al. | 123/41.31 |
| 2011/0259287 | A1 * | 10/2011 | Kakehashi et al. | 123/41.09 |
| 2012/0103283 | A1 * | 5/2012 | Mehring et al. | 123/41.02 |
| 2012/0174579 | A1 * | 7/2012 | Brinkmann | 60/605.3 |
| 2012/0180989 | A1 * | 7/2012 | Ota et al. | 165/104.13 |
| 2012/0192557 | A1 * | 8/2012 | Johnson et al. | 60/599 |

FOREIGN PATENT DOCUMENTS

| | | | | | |
|---|---|---|---|---|---|
| DE | 102006044680 | A1 * | 4/2008 | | |
| EP | 0 038 556 | B1 | 1/1984 | | |
| EP | 1 900 919 | A1 | 3/2008 | | |
| JP | 63235623 | A * | 9/1988 | | |
| JP | 07042550 | A * | 2/1995 | | |
| JP | 2000073777 | A * | 3/2000 | | F02B 39/00 |
| JP | 2006090382 | A * | 4/2006 | | F02B 39/00 |
| JP | 2007192175 | A * | 8/2007 | | F02B 39/00 |
| JP | 2008019711 | A * | 1/2008 | | F02B 39/00 |
| JP | 2010038091 | A * | 2/2010 | | F02B 39/00 |
| JP | 2010048187 | A * | 3/2010 | | F02B 39/00 |
| JP | 2011226390 | A * | 11/2011 | | F02B 39/00 |
| WO | WO 2009106166 | A1 * | 9/2009 | | F01D 25/26 |

* cited by examiner

SEPARATELY COOLED TURBOCHARGER FOR MAINTAINING A NO-FLOW STRATEGY OF AN ENGINE BLOCK COOLANT JACKET

CROSS-REFERENCE TO RELATED APPLICATIONS

This application claims priority to European Patent Application Number 10 165 035.6 filed Jun. 7, 2010 entitled "SEPARATELY COOLED TURBOCHARGER FOR MAINTAINING A NO-FLOW STRATEGY OF A CYLINDER BLOCK COOLANT JACKET" the entire contents of which are hereby incorporated herein by reference for all purposes.

FIELD

The invention relates to an internal combustion engine having an engine block coolant jacket, a cylinder head coolant jacket, and a turbocharger including a turbine positioned in an exhaust conduit.

BACKGROUND

Coolant jackets in both the engine block and the cylinder head have been developed to remove heat from the engine to improve engine operation. EP 0 038 556 B1, for example, describes a cooling system for an internal combustion engine. A first pump is configured to flow coolant through a cylinder head cooling jacket. A second pump is configured to flow coolant through the engine block coolant jacket. The two cooling jackets do not have any connection within the internal combustion engine, but are both fluidly coupled to an outlet conduit in a main cooling circuit. A cooler bypass conduit branches off from the main cooling circuit. The cooler bypass conduit is fluidly coupled to an inlet in both the cylinder head coolant jacket and the engine block coolant jacket. A control valve in the main cooling circuit is configured to selectively inhibit coolant flow to a cooler in the main cooling circuit and selectively permit coolant flow through the cooler bypass conduit. Additionally, a second control valve is configured to selectively permit coolant flow into the engine block coolant jacket.

However, using two pumps to control the coolant flow in the engine block coolant jacket and cylinder head coolant jacket may increase the cost, weight, and bulkiness of the engine.

Therefore, in some engines coolant jackets in the engine block and the cylinder head may be fluidly separated and coupled to a single pump. In other words, coolant may flow through the coolant jackets in a parallel flow configuration. This arrangement may be referred to as a split cooling design. In this way, the cylinder head, which is thermally coupled primarily to the combustion chamber wall and the exhaust conduits, and the engine block, which is thermally coupled primarily to the friction points, can be cooled differently. The aim of the split cooling design is to provide cooling to the cylinder head and inhibit cooling of the engine block during a warm-up phase. In this way, the engine block can be brought up to the required operating temperature more quickly during start-up.

For example, EP 1 900 919 A1, discloses a split coolant circuit of an internal combustion engine, with a cylinder head coolant jacket and an engine block coolant jacket are provided. The split coolant circuit further includes a pump, a cooler, a thermostat and a heating arrangement, and with a coolant circulating in the split coolant circuit. The thermostat is arranged so as to control the flow of the coolant both through the engine block coolant jacket and through the cooler when the coolant exceeds a predefined temperature.

When a split cooling circuit is utilized in an internal combustion engine, friction losses in the warm-up phase can be reduced. However, the split coolant design also heats the engine oil, the coolant, and/or the surfaces of the piston skirts more quickly. Thus, coolant flow strategies have been developed to substantially inhibit coolant flow through the engine block coolant jacket for an extended duration to reduce friction losses during the warm-up phase, in particular after a cold start of the internal combustion engine. This type of coolant flow strategy may be referred to as a "no-flow strategy" for the engine block coolant jacket.

However, vapor may develop in the engine block coolant jacket which may increase temperature variability within the engine block when a "no-flow strategy" is utilized. As a result the engine block may experience thermal degradation. To combat this thermal degradation, coolant may be flowed into the engine block coolant jacket prematurely to reduce the likelihood of engine block degradation.

For example, some engine may include an internal connection between the engine block coolant jacket and the cylinder head coolant jacket such that coolant vapor, formed in the engine block coolant jacket when flow is substantially inhibited in the jacket, can be conducted into the cylinder head coolant jacket, preferably into an inlet-side head coolant jacket. By discharging the hot gases (these naturally collect at an upper region), the no-flow strategy for the engine block coolant jacket can be maintained for longer, because said regions in which hot vapors otherwise accumulate can be traversed by coolant, such that the likelihood thermal damage in said regions is advantageously reduced.

Furthermore, in the case of the no-flow strategy for the engine block coolant jacket, or in the case of the split cooling concept, a situation may arise in which the amount of heat in the cooling circuit cannot meet the heating demands (e.g., cabin heating, window defrost, etc.) in the vehicle.

Furthermore, turbochargers have a turbine and a compressor, with the turbine being driven by means of the exhaust-gas flows such that the compressor side can produce compressed air which is supplied to the internal combustion engine. The turbine may experience thermal loading during engine operation which may lead to thermal degradation of the turbine. Therefore, the turbine housing may be produced from a high-alloyed cast steel in order to withstand the high temperature loadings of the exhaust gases. However, the cast steel is very expensive to produce in particular on account of its alloy elements, for example 37 weight percentage of nickel. Moreover, cast steel is not only expensive but also has a relatively high weight with any additional weight having an adverse effect on the fuel consumption of the motor vehicle as a whole.

SUMMARY

As such in one approach an internal combustion engine is provided. The internal combustion engine may include a turbocharger including a turbine positioned in an exhaust passage, the turbine having a turbine housing. The internal combustion engine may further include a cooling system having an engine block coolant jacket fluidly coupled to a pump, a cylinder head coolant jacket fluidly coupled to the pump, and a turbine coolant passage traversing the turbine housing and fluidly coupled to the pump and bypassing the engine block coolant jacket.

In this way, heat may be extracted from the cylinder head while coolant is substantially inhibited from flowing through the engine block during certain operation conditions, such as during warm-up. The heat may be transferred to other vehicle systems such as a cabin heating arrangement. Furthermore, cooling the turbine via the turbine coolant passage enables various turbine components such as the turbine housing to be constructed out of a light-weight material that is more susceptible to thermal degradation such as aluminum when compared to other material such as cast steel. In this way, the weight of the turbine may be reduced as a result of the increased cooling provided by the turbine coolant passage.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE FIGURES

In the different figures, similar parts are provided similar reference numbers.

DETAILED DESCRIPTION

Figure 1:
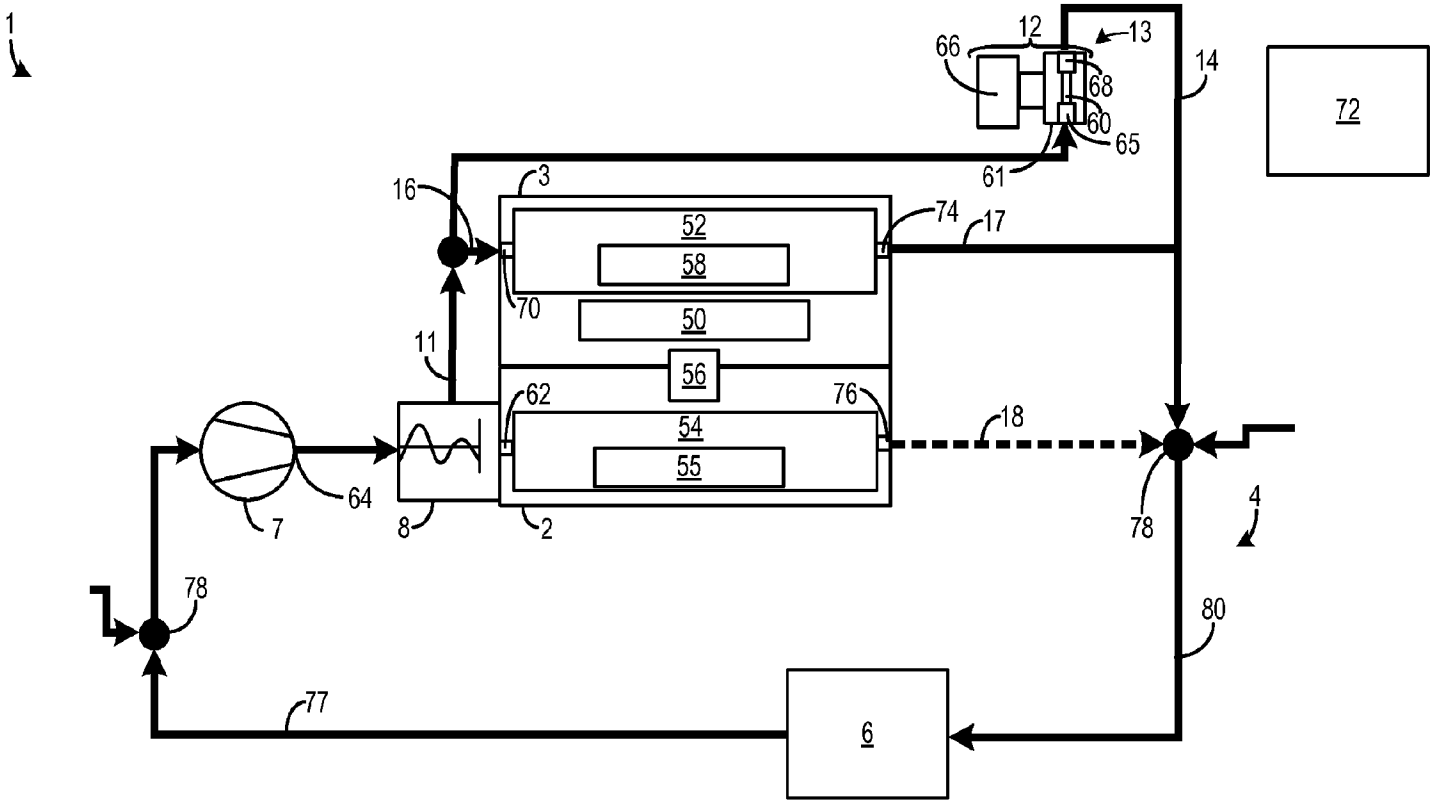
FIG. 1 shows a diagrammatic sketch of an internal combustion engine having a cooling system including a cylinder head coolant jacket, an engine block coolant jacket, and a turbine coolant passage fluidly coupled to a pump.

An internal combustion engine is described herein. The internal combustion engine may include a turbocharger including a turbine positioned in an exhaust passage, the turbine having a turbine housing. The internal combustion engine may further include a cooling system having an engine block coolant jacket fluidly coupled to a pump, a cylinder head coolant jacket fluidly coupled to the pump, and a turbine coolant passage traversing the turbine housing and fluidly coupled to the pump and bypassing the engine block coolant jacket. In some examples, a thermostat may be positioned downstream of the pump and upstream of the engine block coolant jacket, cylinder head coolant jacket, and turbine coolant passage. The thermostat may be configured to control the flow of coolant into the engine block coolant jacket, cylinder head coolant jacket, and/or turbine coolant passage based on the temperature of the coolant or engine.

Various coolant flow control strategies may be employed in cooling system. For example, coolant flow to the engine block coolant jacket may be inhibited for the substantial duration of a cold start in the engine while at the same time coolant may be flowed through the turbine coolant passage and/or the cylinder head coolant jacket. As a result, heat may be provided to various vehicle systems (e.g., cabin heating arrangement) from the cooling system during a cold-start. This type of control strategy may be referred to as a "no-flow" strategy. In this way, it is thus possible to substantially inhibit the flow of coolant through the engine block coolant jacket for a desired duration during certain operating conditions such as during a cold-start when the engine is below a threshold temperature.

Furthermore, when coolant is flowed through the turbine coolant passage additional heat may be extracted from the engine and delivered to other systems in the vehicle, such as a cabin heating arrangement, while coolant flow to the engine block coolant jacket is substantially inhibited. In this way, a "no-flow" strategy in the engine block coolant jacket may be used during cold starts to warm-up lubrication fluid and lubricated surfaces in various engine block components (e.g., stationary and moving components) quickly, thereby improving engine operation while at the same time heat may extracted from the engine and provided to other vehicle systems without discontinuing the "no-flow" strategy. When, the engine block is warmed-up quickly fuel consumption of the internal combustion engine is reduced.

Furthermore, when coolant is routed through the turbine, various components of the turbine, such as the housing, may be constructed out of a material that is less resistant to thermal degradation due to the decreased temperature in the turbine housing and adjacent turbine components. Therefore, in some embodiments the turbine housing may be constructed out of aluminum as opposed to cast steel having alloy elements. As a result, the cost of the turbine may be reduced due to the reduced price of aluminum when compared to cast steel. Furthermore, aluminum may be lighter than cast steel, thereby reducing the weight of the turbine. Thus, the fuel consumption of the engine may be reduced when the weight of the turbine is reduced.

Further in some embodiments, the engine may include an exhaust gas-collector which may be integrated into the cylinder head. The integrated exhaust-gas collector may be referred to as an integrated exhaust manifold. When the exhaust-collector is integrated into the cylinder head, cylinder head coolant jacket may include one or more coolant passages adjacent to the exhaust gas collector. On the other hand when the exhaust-collector is not integrated into the cylinder head, coolant passages at least partially surrounding the exhaust-gas collector may be fluidly coupled downstream of the cylinder head coolant jacket. A coolant line may be fluidly coupled to the outlet of the pump and an inlet of the cylinder head coolant jacket. In this way, the exhaust-gas collector may be cooled while coolant flow is substantially inhibited to the engine block coolant jacket. It will be appreciated that when coolant is flowed in passages adjacent to the exhaust-gas collector additional heat may be transferred to the coolant increasing the amount of heat that may be delivered to other systems in the vehicle via the cooling system. Specifically an increased amount of heat may be delivered to a cabin heating arrangement during a cold start if there is a request for cabin heating.

FIG. 1 shows an internal combustion engine 1 having an engine block 2 and a cylinder head 3. The cylinder head 3 and the engine block 2 may be coupled together to form at least one cylinder 56. Although a single cylinder is depicted it will be appreciated that the internal combustion engine may include a plurality of cylinders in other embodiments. For example, the internal combustion engine 1 may include 3 cylinders. The cylinder head 3 may include an outlet side including one or more exhaust passages and an intake side including one or more intake passages. In some embodiments the outlet side of the cylinder head 3 may include an integrated exhaust-gas collector 50. However, in other embodiments the exhaust-gas collector may be positioned exterior to the cylinder head 3. The integrated exhaust gas collector may be referred to as an integrated exhaust manifold.

The integrated exhaust manifold may be the confluence of exhaust lines from each of the cylinders in the engine. Furthermore, the integrated exhaust manifold may be fluidly coupled to exhaust-gas after-treatment devices (e.g., catalysts, filters, etc.). The exhaust-gas after-treatment devices may be exterior to the cylinder head. When an integrated exhaust manifold is utilized, it may be possible to increase the temperature of the exhaust-gas after-treatment devices more quickly due to the reduction in effective surface area of the various conduits in the exhaust stream, upstream of the treatment devices. Further in some embodiments, coolant passages may included in the cylinder head adjacent integrated exhaust-gas collector 50. The coolant passages may be included in a cylinder head coolant jacket 52.

The cylinder head 3 may include the cylinder head coolant jacket 52 and the engine block 2 may have an engine block coolant jacket 54. The cylinder head coolant jacket 52 may include at least one coolant passage 58 traversing the cylinder head 3. In some embodiments the coolant passage 58 may be adjacent to the integrated exhaust-gas collector 50. However, in other embodiments, additional coolant passage fluidly separated from the cylinder head coolant jacket 52 may adjacent to the integrated exhaust-gas collector 50. The additional, coolant passage may be included in the cylinder head coolant jacket 52. In this way, the exhaust-gas collector 50 may be cooled. Additionally, the engine block coolant jacket 52 may include at least one coolant passage 55 traversing the engine block 2.

In other embodiments the cylinder head 3 may have an additional coolant jacket fluidly separated from the first cylinder head coolant jacket 52. The second cylinder head coolant jacket may be adjacent to one or more cylinder intake passages. Additionally, the second cylinder head coolant jacket may be fluidly separated from a turbine coolant passage 60, discussed in greater detail herein. Further in some embodiments, the second cylinder head coolant jacket may be coupled to the engine block coolant jacket 54 via bores (e.g., gas venting bores) in a cylinder head seal (not shown), the bores may be configured to enable gas to pass from the engine block coolant jacket 54 to the second cylinder head coolant jacket. In this way, vapor which may be formed when coolant flow is substantially inhibited in the engine block coolant jacket may be vented.

The internal combustion engine 1 includes a cooling system 4. The cooling system 4 may include various coolant lines, coolant passages, pumps, etc., enabling coolant to be flowed around various locations in the engine. Specifically, the cooling system 4 includes a cabin heating arrangement 6 or other suitable heat exchanger configured to transfer heat from the coolant in the cooling system to another medium, such as the surrounding air. The cabin heating arrangement 6 may be configured to transfer heat from the coolant to a cabin in a vehicle in which the internal combustion engine is arranged. The cooling system 4 may further include a pump 7 that is configured to flow coolant to a split cooling thermostat 8. The coolant pump may be held in or at least partially covered by a covering hood (e.g., front cover). Likewise the split cooling thermostat 8 may be, for example, held in or at least partially covered by a thermostat housing. The split cooling thermostat 8 is arranged between a pump outlet and an engine block coolant jacket inlet. The split cooling thermostat 8 may fluidly coupled to an inlet 62 of the engine block coolant jacket 54. Specifically, in some examples, the split cooling thermostat 8 may be positioned at the inlet 62. In this way, the split cooling thermostat 8 is arranged downstream of an outlet 64 of the pump 7 and upstream of the inlet 62 engine block coolant jacket 54. Further in some embodiments the split cooling thermostat 8 may be directly integrated into a portion of the engine block 2 and/or the engine block coolant jacket 54. In this way, the thermostat may adjust coolant flow to various downstream components based on the temperature of the engine block and/or the coolant in the engine block coolant jacket. The split cooling thermostat 8 may selectively inhibit coolant flow in the engine block coolant jacket 54 based on an engine temperature. Further in some examples, coolant flow through bypass 11 may be permitted during engine operation. However in other examples, coolant flow through bypass 11 may be selectively permitted during engine operation. A detailed coolant flow control strategy is discussed in greater detail herein. Additional components, not depicted in the figures, may be included in the cooling system 4 such as a ventilation device, a main cooler, further thermostats, lines or connecting lines, further bypass, oil cooler and main thermostat, are not illustrated in the figures.

A bypass 11 may be fluidly coupled to and branches off from the split cooling thermostat 8 downstream of the pump 7 and upstream of the inlet 62. In some embodiments, the bypass may traverse a portion of the engine block 2 spaced away from cylinder 56 and traverse a portion of the cylinder head 3 leading to the inlet 70 of the cylinder head coolant jacket 52. In this respect, the bypass may advantageously be formed either as a duct which is cast into the components or as a drilled duct, that is to say as a coolant duct. In an example embodiment, the bypass 11 may be integrated in the engine block as a coolant duct, that is to say between the pump 7 and the cylinder head 3. In yet another embodiment, the bypass 11, or the corresponding coolant ducts, may be guided in the front cover, in the engine block 2, through the cylinder head seal and into the an outlet-side of the cylinder head 3, with the exhaust-gas collector being integrated in the cylinder head (at the outlet-side). Still further in other embodiments bypass 11 may be a coolant line external to the engine block 2. In this way, coolant may be delivered directly to the turbine coolant passage 60 from the pump 7, increasing the temperature differential between the coolant and the turbine, thereby increased the amount of heat transferred to the coolant in the turbine coolant passage 60.

The bypass 11 may be fluidly coupled to an inlet 65 of the turbine coolant passage 60 which may traverse the housing 61 of turbine 13. The housing 61 may at least partially enclose a rotor assembly (not shown) included in the turbine. It will be appreciated that the turbine 13 may be positioned in an exhaust passage in the internal combustion engine 1. The turbine 13 may be included in a turbocharger 12 having a compressor 66 positioned in an intake passage of the engine. The compressor 66 and turbine 13 may be coupled via a shaft or other suitable component configured to transfer rotational energy from the turbine to the compressor. A coolant line 14 may be fluidly coupled to an outlet 68 of the turbine coolant passage 60 and to coolant line 17 positioned downstream of the engine block coolant jacket 54 and the cylinder head coolant jacket 52. In this way, heat from the engine block (e.g., integrated exhaust manifold) and the turbine may be transferred to the cabin heating arrangement 6 via coolant. Additionally, connecting line 16 may be fluidly coupled to coolant line 14 and the inlet 70 of the cylinder head coolant jacket 52, enabling the flow of coolant from bypass 11 to the cylinder head coolant jacket. However in other embodiments, such as the embodiment shown in FIG. 2 coolant line 14 may be fluidly coupled to an inlet 70 of the cylinder head coolant jacket 52.

The split cooling thermostat 8 may be configured to adjust the coolant flow to the cylinder head coolant jacket 52, the engine block coolant jacket 54, and/or the turbine coolant passage 60.

An outlet 74 of the cylinder head coolant jacket 52 may be fluidly coupled to a coolant line 17. Additionally coolant line 17 may be fluidly coupled to coolant line 80. Likewise an outlet 76 of the engine block coolant jacket 54 may be fluidly coupled to coolant line 80 via outlet line 18, depicted via a dashed line. It will be appreciated that coolant may travel through outlet line 18 when coolant flow is permitted through the engine block coolant jacket via split cooling thermostat 8. Additionally coolant line 17 may be fluidly coupled to the cabin heating arrangement 6 or other suitable heat exchanger. Pump 7 if fluidly coupled to the cabin heating arrangement via coolant line 77. In this way, the cooling system 4 may include a full coolant circuit. In the depicted embodiment, coolant may be flowed into the cooling system 4 via coolant junctions 78. However, in other embodiments coolant junctions 78 may not be included in the cooling system 4.

Various control techniques may be used to adjust coolant flow in the cooling system 4. It will be appreciated that the control techniques may be programmed into the individual components such as the split cooling thermostat 8 and the pump 7 or may be implemented via a controller 72 in electronic communication (e.g., wired, wireless) with the split cooling thermostat 8, the pump 7, and additional electronically adjustable components that may be included in the cooling system 4.

In one example control strategy, cooling system 4 may be operated to substantially inhibit coolant flow to the engine block coolant jacket 54 (that is to say with the exception of small leakage quantities) and permit coolant flow to the turbine coolant passage 60 and/or the cylinder head coolant jacket 52 during certain operating conditions. In particular, the cooling system may be controlled to substantially inhibit coolant flow through the engine block coolant jacket for a long time, even if there is a request from vehicle occupants for cabin heating, for example. This is because, heat can be extracted from the turbine housing as well as the cylinder head and delivered to the cabin heating arrangement without placing a load on the actual cooling circuit of the engine block coolant jacket. In this way, coolant may bypass the engine block coolant jacket 54. This control strategy may be implemented during at least a portion of an engine warm-up phase when the internal combustion engine 1 is below a threshold temperature. In this way, the various components in the engine block may be quickly heated, reducing friction losses as well as engine wear caused by lubricant (e.g., oil) that is below a desired operating temperature.

Furthermore, heat from the turbine coolant passage 60 and/or cylinder head coolant jacket 52 may be transferred to the cabin heating arrangement 6. As a result heat may be delivered to the cabin in response to a request from a vehicle occupant during the warm-up phase, enabling heat from the exhaust-gas flowing through the turbine 13 to be recovered and supplied for example to the cabin heating arrangement 6. In this way, coolant flow may be substantially inhibited to the engine block coolant jacket 52 even if for example cabin heating is demanded of the cabin heating arrangement 6. Thus, cabin heating does not have to be abandoned when coolant flow through the engine block coolant jacket 54 is inhibited. For this purpose, coolant flow to the turbine coolant passage 60 via bypass 11 may be provided when substantially no coolant is flowing through the engine block coolant jacket 54 or coolant flow is increased through the engine block coolant jacket 54 in a continuous fashion during further partial phases of the warm-up phase.

As a result of the cooling provided to the turbine via the cooling system 4 various components in the turbine 13, such as the housing of the turbine, may be constructed out of a material that is lighter as well as less resistant to thermal degradation when compared to cast steel alloy. For example, the turbine housing may be constructed out of aluminum.

When the engine warm-up phase is over (e.g., when the engine block, coolant, etc., has surpassed a threshold temperature) coolant flow to the engine block coolant jacket 54 may be permitted. In this way, the likelihood of thermal degradation of the engine block coolant jacket 54 may be reduced.

In another strategy, when the warm-up phase or at least a partial phase of the warm-up phase, in which the no-flow strategy of the engine block coolant jacket is implemented, comes to an end because the coolant temperature in the engine block has reached a predefined value, coolant may be permitted to flow through the split cooling thermostat 8 into the engine block coolant jacket and through corresponding bores into the second cylinder head coolant jacket, from where the coolant passes for example into the outlet 74 and mixes with the coolant from the first cylinder head coolant jacket. It is self-evidently also possible to dispense with the outlet 74, wherein mixing can then take place in the cabin heating arrangement 6 and/or in the feed line thereto. Further in some embodiments the second cylinder head coolant jacket may be separated from the first cylinder head coolant jacket via a partition.

Figure 2:
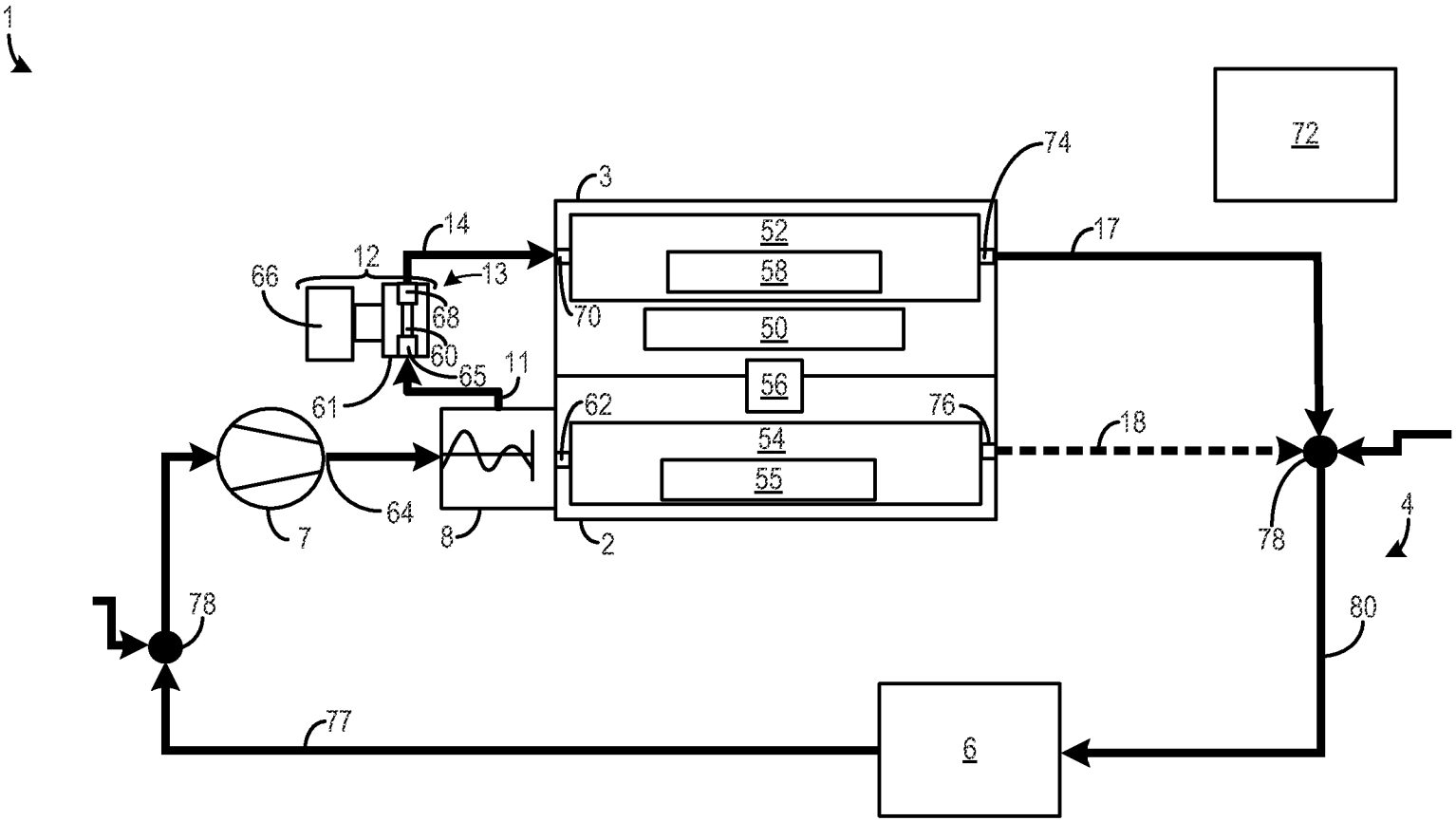
FIG. 2-FIG. 5 show additional embodiments of the cooling system shown in FIG. 1.

In the exemplary embodiment illustrated in FIG. 1, the turbine coolant passage 60 and the cylinder head coolant jacket 52, are fluidly connected in a parallel flow configuration. A parallel flow configuration is a configuration in which an inlet of the first component is fluidly coupled to the inlet of the second component and the outlet of the first component is fluidly coupled to an outlet of the second component. In this way coolant flows through the components in parallel. On the other hand a series flow configured is a configuration in which an outlet of a first component is fluidly coupled to an inlet of a second component. In this way, coolant flows through the components in series. As depicted the inlet 65 of the turbine coolant passage 60 and the inlet 70 of cylinder head coolant jacket 52 are fluidly coupled to the pump 7 via bypass 11. Likewise, outlet 68 of the turbine coolant passage 60 and outlet 74 of the cylinder head coolant jacket 52 may be fluidly coupled. In contrast to the exemplary embodiment shown in FIG. 1, FIGS. 2-6 show the turbine coolant passage 60 and the cylinder head coolant jacket 52 fluidly coupled in a series flow configuration. Specifically, FIG. 2 illustrates the turbine coolant passage 60 coupled in a series flow configuration and positioned upstream of the cylinder head coolant jacket 52. In FIG. 2, the bypass 11 flows coolant firstly to the turbine coolant passage 60, to the coolant line 14, and then to the cylinder head coolant jacket 52. In FIG. 2, the coolant line 14 may also be referred to as an inlet connecting line 16. As shown in FIG. 2 coolant line 17 is fluidly coupled to coolant line 80. Therefore in the embodiment depicted in FIG. 2 the turbine coolant passage 60 is fluidly coupled upstream of the cylinder head coolant jacket 52. However in the embodiment shown in FIG. 4, the turbine coolant passage 60 may be fluidly coupled downstream of the cylinder head coolant jacket 52.

Figure 3:
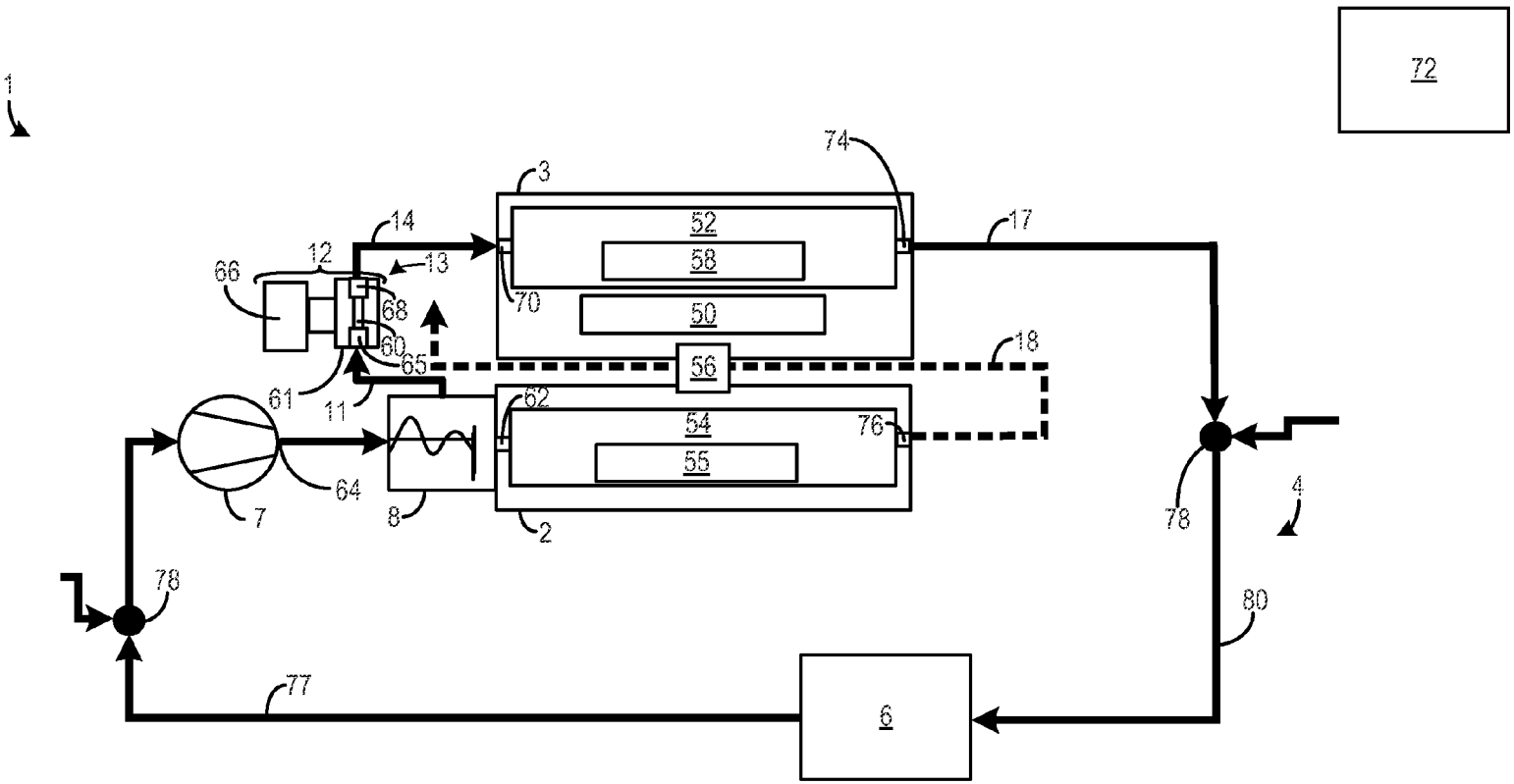

FIG. 3 illustrates an embodiment of the cooling system 4 in which the outlet line 18 may be fluidly coupled to coolant line 14 upstream of the cylinder head coolant jacket 52. The outlet line 18 may also be fluidly coupled to coolant line 80, as described with regard to FIG. 2, such that the outlet line 18 is in effect divided into two partial branches. The branch which opens out into the coolant line 14 would then be traversed by flow depending on the pressure drop in the turbine coolant passage 60 (in terms of the coolant flow therein), with the other coolant flow travelling into coolant line 80. A control element, such as a valve, may also be provided for controlling an adjustable magnitude of the coolant flow in the respective branch of outlet line 18.

Figure 4:
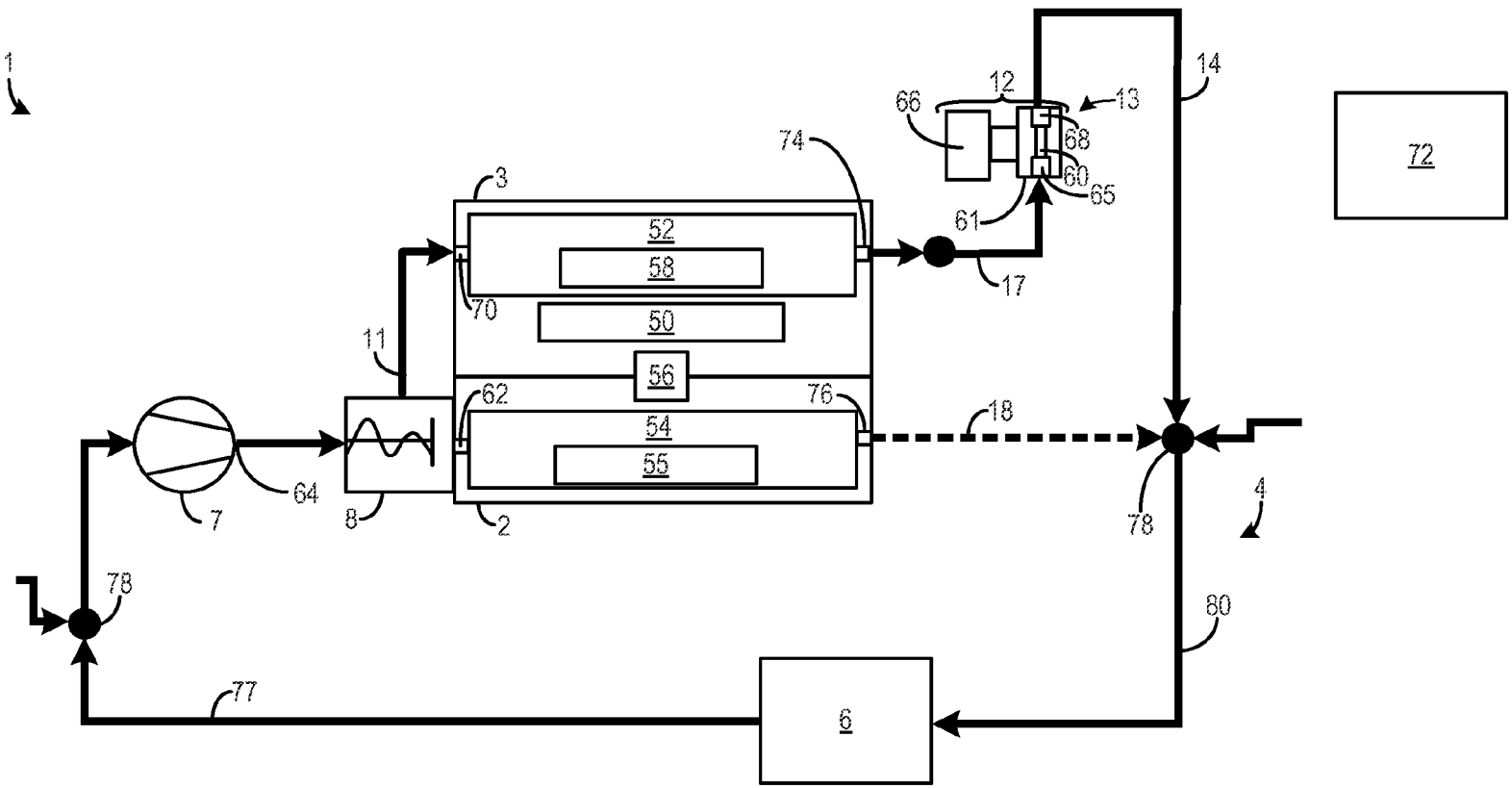

The exemplary embodiment illustrated in FIG. 4 shows a series flow configuration between the turbine coolant passage 60 and the cylinder head coolant jacket 52. However, the turbine coolant passage 60 is positioned downstream of the cylinder head coolant jacket 52 in the depicted embodiment. As depicted, the bypass 11 may be directly coupled to the inlet 70 of the cylinder head coolant jacket 52 and coolant line 17 is directly coupled to the inlet 65 of the turbine coolant passage 60. Additionally, the outlet 68 is fluidly coupled to coolant line 80 via coolant line 14. A dashed line again shows the outlet line 18 of the engine block coolant jacket which, as in the exemplary embodiment of FIG. 2, is positioned in the cooling system 4 downstream of the turbine coolant passage 60.

Figure 5:
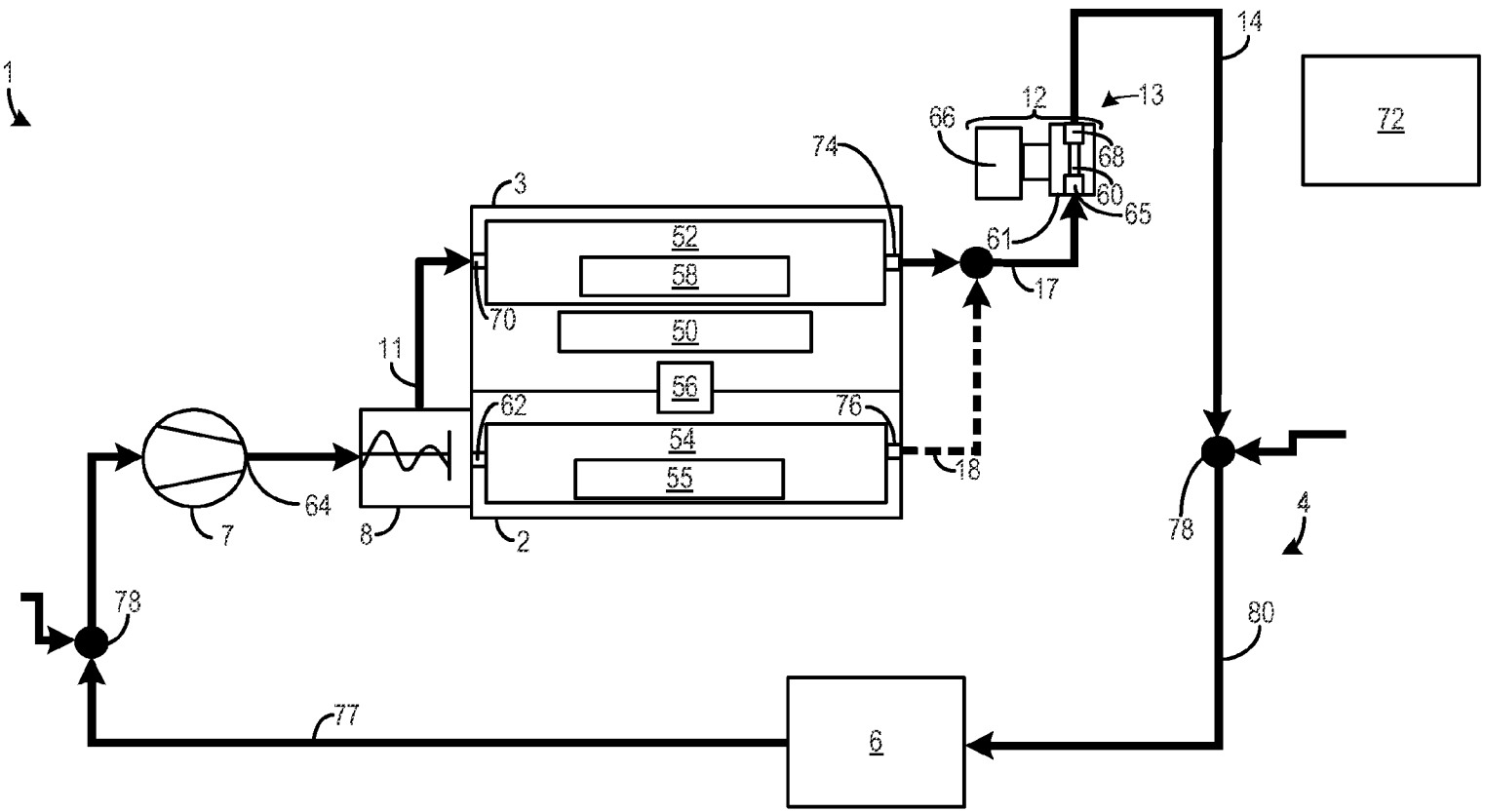

The exemplary embodiment of FIG. 5 illustrates the series flow configuration according to FIG. 4, with the outlet line 18 however fluidly coupled to coolant line 17 upstream of the turbine coolant passage 60. Further in other embodiments, the outlet line 18 may split into two partial branches, such that the branch which opens out into the outlet coolant line 17 would then be traversed by flow depending on the pressure drop (in terms of the coolant flow), with the other branch fluidly coupled to coolant line 80. A control element (e.g., valve) may be provided here for controlling an adjustable magnitude of the coolant flow in the respective branch.

It will be appreciated that the internal combustion engine 1 is schematically depicted in FIGS. 1-5. Thus, the internal combustion engine may include additional features that are not illustrated. For example, the engine block coolant jacket 54 may be connected to a second cylinder head coolant jacket via bores or degassing bores in the cylinder head seal. In such an embodiment, during a warm-up phase when the engine is below a threshold temperature coolant flow to the engine block coolant jacket 54 may be substantially inhibited via the split cooling thermostat 8. The hot coolant vapors in the engine block coolant jacket 54 which thereby form can be discharged via the aforementioned bores. In this way, the likelihood of thermal damage to the engine block may be decreased, enabling coolant flow through the engine block coolant jacket to be inhibited for a long duration.

Furthermore, a separate pump may be provided in a coolant circuit including the coolant the turbine coolant passage 60, the exhaust-gas collector 50, and the cabin heating arrangement 6. In this way, coolant flow through the aforementioned passages may be adjusted separately from the coolant flow through the engine block and cylinder head coolant jackets. The second pump may be activated for a duration of the warm-up phase or a partial phase of the warm-up phase. The second pump may also act so as to assist the first pump 7.

Figure 6:
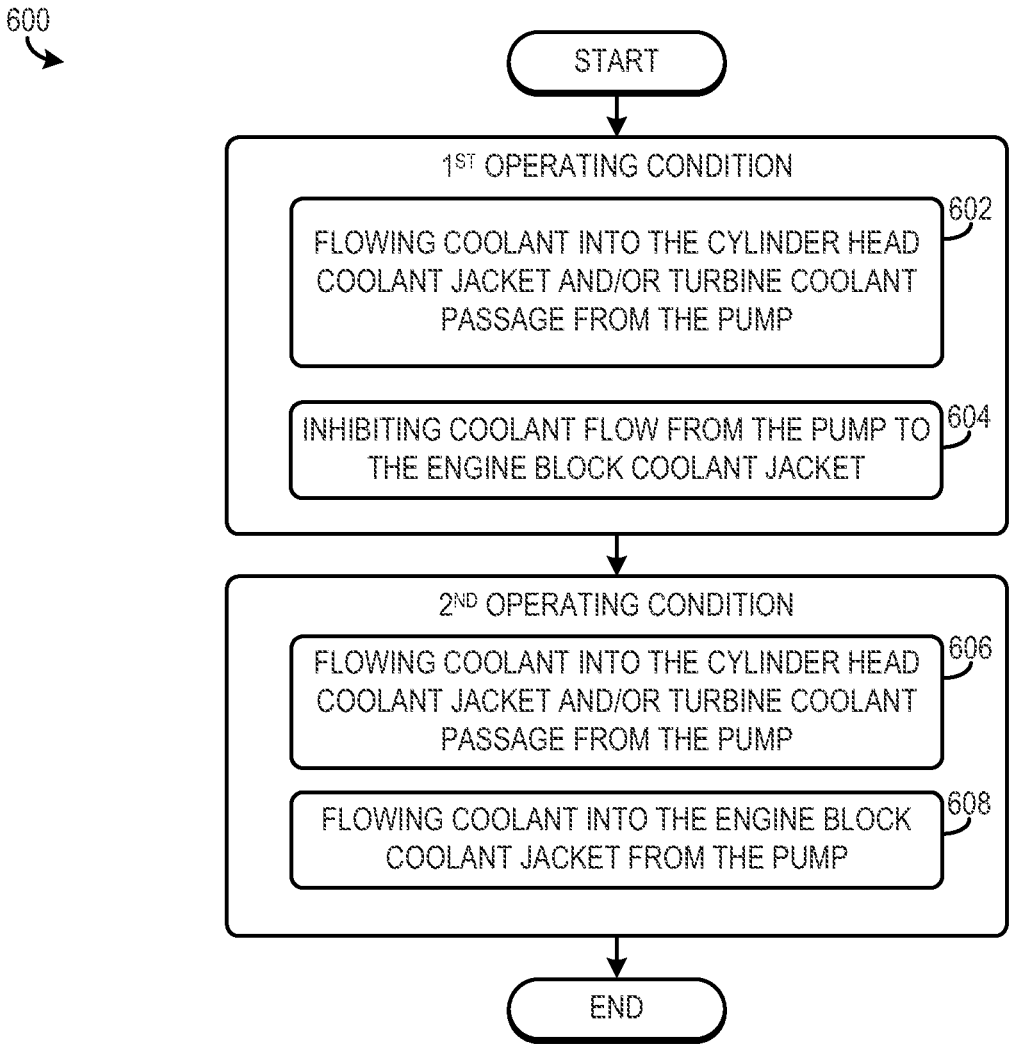
FIG. 6 shows a method for operation of a cooling system in an internal combustion engine.

FIG. 6 shows a method 600 for operation of a cooling system in an internal combustion engine. Method 600 may be implemented via the system and components described above or may be implemented via other suitable systems and components. Specifically in one example, the method may be carried out in an internal combustion engine including turbocharger including a turbine positioned in an exhaust passage and a cooling system including a pump fluidly coupled to an engine block coolant jacket, a cylinder head coolant jacket, and a turbine coolant passage traversing a housing of the turbine.

Steps 602 and 604 may be implemented during a first operating conditions, such as during a warm-up phase in which the temperature of the internal combustion engine is below a threshold value. Steps 606 and 608 may be implemented during a second operating condition such as when the temperature of the internal combustion engine has reached and/or surpassed a threshold value.

Method 600 includes at 602 flowing coolant into the cylinder head coolant jacket and/or turbine coolant passage from the pump. Next at 604 method 600 includes inhibiting coolant flow from the pump to the engine block coolant jacket.

At 606 the method includes flowing coolant into the cylinder head coolant jacket and/or turbine coolant passage from the pump. Next at 608 the method includes flowing coolant into the engine block coolant jacket from the pump.

It will be appreciated that the configurations and/or approaches described herein are exemplary in nature, and that these specific embodiments or examples are not to be considered in a limiting sense, because numerous variations are possible. The subject matter of the present disclosure includes all novel and nonobvious combinations and subcombinations of the various features, functions, acts, and/or properties disclosed herein, as well as any and all equivalents thereof.

The invention claimed is:

1. A method for operating a cooling system in an internal combustion engine having a turbocharger including a turbine positioned in an exhaust passage and a cooling system including a pump fluidly coupled to an engine block coolant jacket of an engine block, a cylinder head coolant jacket of a cylinder head, and a turbine coolant passage traversing a housing of the turbine, the method comprising:

during a first operating condition, flowing coolant from the pump into the cylinder head coolant jacket and the turbine coolant passage and inhibiting coolant flow from the pump to the cylinder head coolant jacket, the cylinder head coolant jacket fluidly connected to the engine block coolant jacket in a parallel flow configuration, the parallel flow configuration being one in which an inlet of the engine block coolant jacket is fluidly coupled to an inlet of the cylinder head coolant jacket at a first location apart from the engine block and the cylinder head and an outlet of the engine block coolant jacket is fluidly coupled to an outlet of the cylinder head coolant jacket at a second location apart from the engine block and the cylinder head.

2. The method of claim 1, further comprising, during a second operating condition, flowing coolant from the pump into the engine block coolant jacket and flowing coolant from the pump into the cylinder head coolant jacket and the turbine coolant passage.

3. The method of claim 1, wherein the first operating condition is a warm-up phase in which a temperature of the internal combustion engine is below a threshold value.

4. The method of claim 1, wherein the cylinder head coolant jacket traverses a portion of a cylinder head adjacent to one or more exhaust passages.

5. The method of claim 1, wherein the one or more exhaust passages are included in an integrated exhaust manifold.

6. An internal combustion engine comprising:

a turbocharger including a turbine positioned in an exhaust passage, the turbine having a turbine housing;

a cooling system including:

an engine block including an engine block coolant jacket fluidly coupled to a pump;

a cylinder head including a cylinder head coolant jacket fluidly coupled to the pump and fluidly connected to the engine block coolant jacket in a parallel flow configuration, the parallel flow configuration being one in which an inlet of the engine block coolant jacket is fluidly coupled to an inlet of the cylinder head coolant jacket at a first location apart from the engine block and cylinder head and an outlet of the engine block coolant jacket is fluidly coupled to an outlet of the cylinder head coolant jacket at a second location apart from the engine block and cylinder head; and a turbine coolant passage traversing the turbine housing and fluidly coupled to the pump and bypassing the engine block coolant jacket.

7. The internal combustion engine in claim 6, wherein the turbine coolant passage is fluidly coupled to a component in the cooling system positioned downstream of the pump and upstream of the engine block coolant jacket.

8. The internal combustion engine of claim 7, wherein the component is a split cooling thermostat.

9. The internal combustion engine of claim 6, wherein the turbine housing is formed from aluminum.

10. The internal combustion engine of claim 6, wherein the turbine coolant passage is fluidly coupled in a parallel flow configuration with the cylinder head coolant jacket.

11. The internal combustion engine of claim 6, wherein the cylinder head coolant jacket traverses at least a portion of the cylinder head.

12. The internal combustion engine of claim 11, wherein the cylinder head coolant jacket traverses a portion of the cylinder head adjacent to an exhaust-gas collector integrated into the cylinder head.

13. The internal combustion engine of claim 6, wherein the engine block coolant jacket traverses a portion of the engine block and the cylinder head coolant jacket traverses a portion of the cylinder head, the engine block and the cylinder head forming at least one cylinder.

14. The internal combustion engine of claim 6, wherein the turbine coolant passage is coupled to the pump via a bypass traversing a portion of the engine block spaced away from a cylinder.

15. The internal combustion engine of claim 6, wherein the turbine coolant passage includes an outlet fluidly coupled to a coolant line in the cooling system positioned downstream of the engine block coolant jacket.

* * * * *